United States Patent [19]

Bungard

[11] Patent Number: 4,884,832

[45] Date of Patent: Dec. 5, 1989

[54] HEAT TRIGGERED DOOR JAMMING MECHANISM

[75] Inventor: Kevin O. Bungard, Rockwood, Pa.

[73] Assignee: Rockwood Manufacturing Company, Rockwood, Pa.

[21] Appl. No.: 247,516

[22] Filed: Sep. 22, 1988

[51] Int. Cl.[4] ..... E05C 1/14

[52] U.S. Cl. ..... 292/173; 292/92; 292/150

[58] Field of Search ..... 292/DIG. 60, 21, 92, 292/150, 173, 207, DIG. 49, 126, 106, 200, 172, DIG. 65

[56] References Cited

U.S. PATENT DOCUMENTS 4,003,593 1/1977 Wilzig et al. ..... 292/DIG. 66 X
4,709,950 12/1987 Zortman ..... 292/DIG. 66 X

*Primary Examiner*—Richard E. Moore
*Attorney, Agent, or Firm*—Stevens, Davis, Miller & Mosher

[57] ABSTRACT

A push door opening mechanism for use where protection from fire is sought. In operation the push handle causes a spring biased operating lever to rotate within the door opener. The operating lever pulls a bolt which allows the door to open. When the lever is in the return position, a cavity in the operating lever is positioned adjacent to a locking pin. That pin is held in the base plate and is longer than the depth of the cavity in the operating lever. The locking pin is also mechanically biased to move into the cavity. Once positioned in the cavity, the rotation of the operating lever is jammed because the locking pin is partially in the operating lever and partially held rigid in the base plate. However, during normal operation, the locking pin is retained out of the cavity by a low melting point fusible link pin. During a fire the base plate becomes hot, causing the link pin to melt which frees the locking pin. The locking pin then moves into the cavity in the operating lever and jams the push door opener.

9 Claims, 2 Drawing Sheets

HEAT TRIGGERED DOOR JAMMING MECHANISM

BACKGROUND OF THE INVENTION

This invention relates to fasteners to close a door and more particularly to fasteners which will not open in a fire.

1. Description of the Prior Art he present invention is an improvement on a structure such as shown, for example in U.S. Pat. No. 4,003,593 to Wilzig et al. The Wilzig invention is limited to a push door latch opener lever that is vertically positioned unlike the present invention. In some physical situations it is advantageous to mount a door opener horizontally, as can be done with the present invention. A further advantage to the present invention is that, unlike the Wilzig invention, the present invention directly acts on the operating lever in the case of a fire. By contrast the Wilzig invention interferes directly with the operation of the push lever itself.

2. Summary of the Invention

A push door opening mechanism is disclosed for use where protection from fire is sought. In operation the push handle causes an operating lever to rotate within the door opener. The operating lever pulls a bolt which allows the door to open. This operating lever is mechanically biased to a return position. When in the return position, a cavity in the operating lever is positioned adjacent to a locking pin. That locking pin is held in the base plate and is longer than the depth of the cavity in the operating lever. The locking pin is also mechanically biased to move into the cavity. Once positioned in the cavity, the rotation of the operating lever is jammed because the locking pin is partially in the operating lever and partially held rigid in the base plate. However, during normal operation, the locking pin is retained out of the cavity by a fusible link pin. The link pin is made of a low melting point material and is in intimate contact with the base plate. During a fire the base plate becomes hot, causing the link pin to melt which frees the locking pin. The locking pin then moves into the cavity in the operating lever and jams the push door opener.

DETAILED DESCRIPTION OF THE INVENTION

Figure 1:
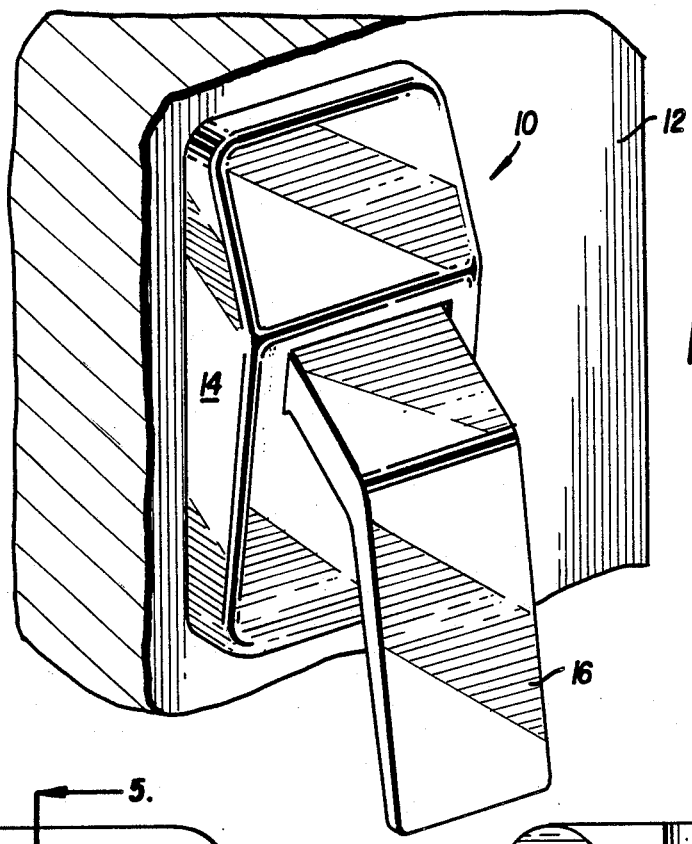
FIG. 1 is a perspective view of the push opening mechanism on a door that is shown partially in section.

FIG. 1 shows a push door opening mechanism 10 mounted on a door 12. Another complementary pull door opener (not shown) would be on the other side of the door. The pull opener on the other side of the door is substantially similar to the push opener, however no jamming function is required on the pull opening mechanism. However, on the push opener may be struck by falling debris during a fire and it is thus desirable to jam the push opener when a fire is present so that the door to a room could not be inadvertently opened. As seen by a user, the push opener has a push handle 16 and a cover piece 14. Though the present drawings show the push opener with push lever in a substantially vertical position, the opener of the present invention may be rotated 90° with the push lever used in a substantially horizontal position.

Figure 3:
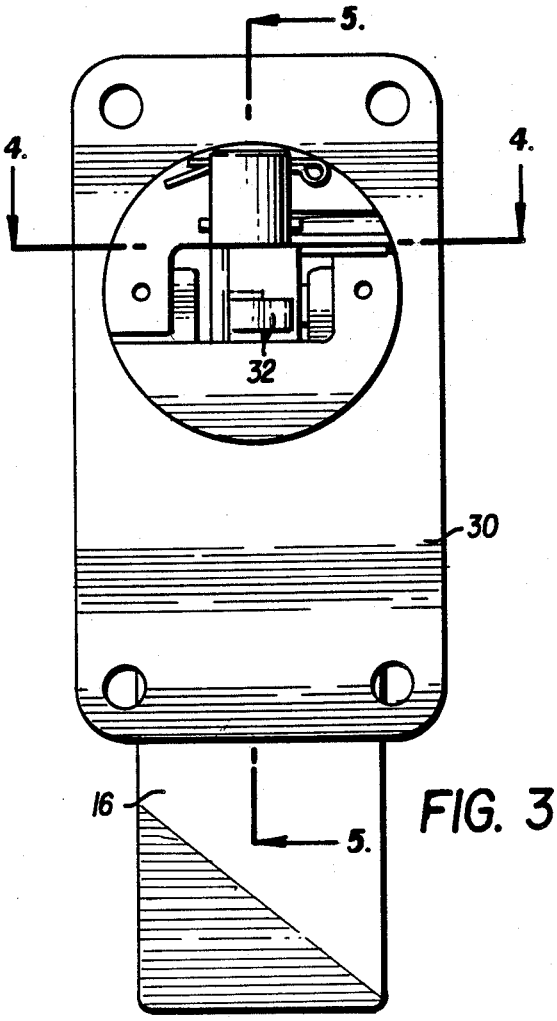
FIG. 3 is the rear elevational view of the push mechanism showing the side which faces the door.
Figure 2:
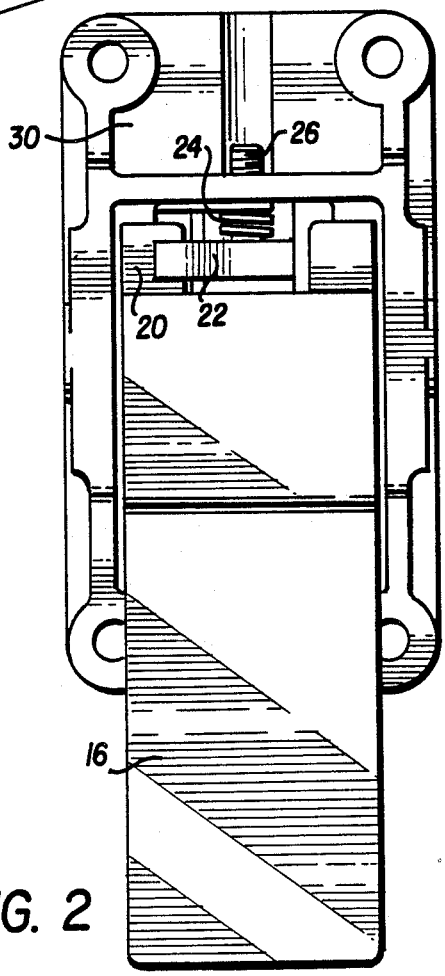
FIG. 2 is a front elevational view of the push mechanism separate from the door and without its cover plate.

When the cover piece 14 of the push opener is removed, a view of the door opening mechanism, as seen in FIG. 2, shows a push handle 16 contacting an operating lever 56. Contact is between a projection 20 on the push lever opposing the push handle 16 and an arm 22 of the operating lever 56. The push mechanism, when viewed from the side which faces the door as seen in FIG. 3 shows a base plate 30 which mounts on the door. The base plate 30 has an opening through which the second arm 32 of the operating lever 56 extends. This second arm 32 is the element which retracts the fastening bolt 54 which otherwise keeps a door closed. The second arm 32 is perpendicular to the first arm 22 of the operating lever 56.

Figure 4:
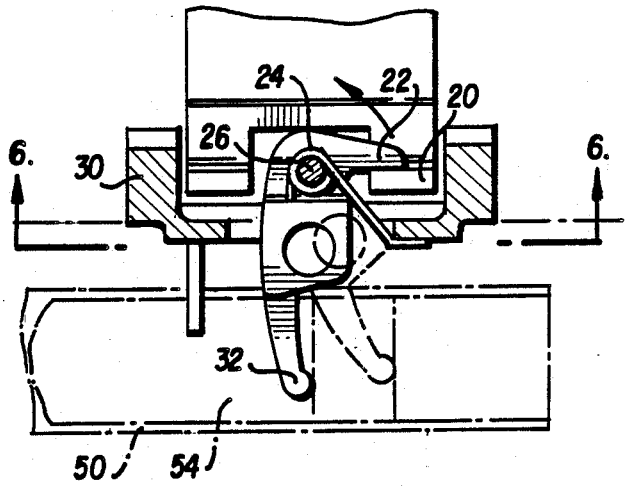
FIG. 4 is a fragmentary top view, partly in section of the push mechanism taken along line 4—4 of FIG. 3.
Figure 5:
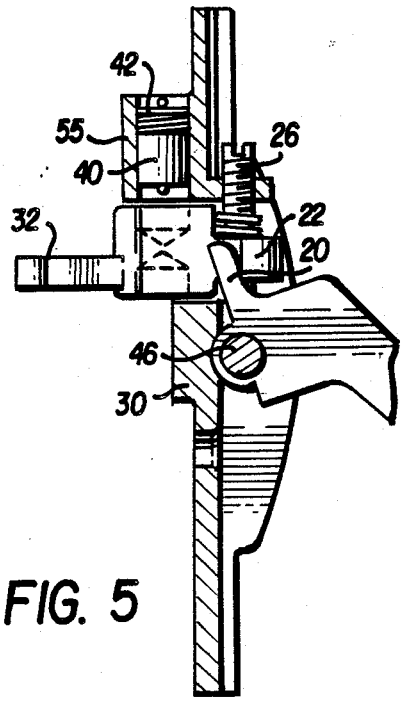
FIG. 5 is a fragmentary side view of the push mechanism taken along line 5—5 of FIG. 3.

The operation of the push mechanism is best seen in FIGS. 4 and 5. The push handle 16 rotates about a pivot pin 46, as does the operating lever 56 about a second pivot pin 26. When the push lever handle 16 is depressed, it rotates on the push lever pivot pin 46 and the projection 20 on the lever simultaneously swings in an arc. This rotation moves the first arm 22 of the operating lever 56 which causes the entire operating lever, including the second arm 32, also to rotate. This rotation of the second arm on the operating lever retracts the door fastening bolt 54 within a tube 50 and allows the door to open. The arrangement just described links the motion of the push handle 16, operating lever 56, and door fastening bolt 54. Opposing the motion of the operating lever (and therefore of the door bolt and push handle) is a torsional spring 24. This spring 24 puts a torque on the operating lever 56 to keep it in a return position. Because of this spring, the operating lever 56 is always in its return position unless the push handle 16 is depressed.

Figure 6:
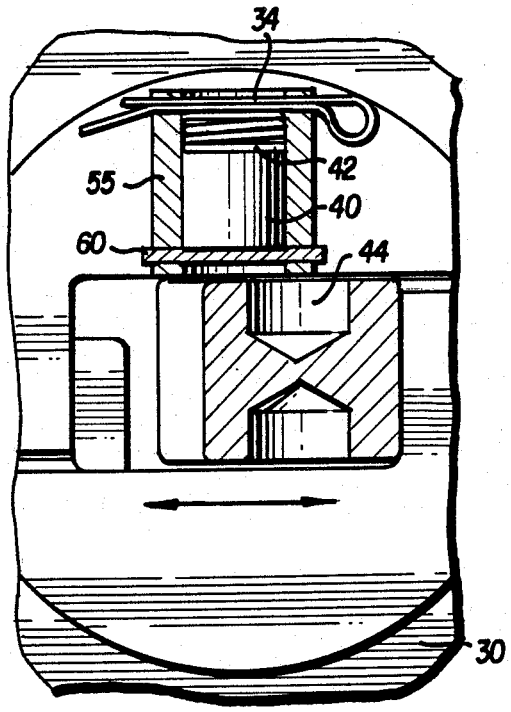
FIG. 6 is a fragmentary view partly in section taken along line 6—6 of FIG. 4 of the locking pin and operating lever under normal operating conditions.
Figure 7:
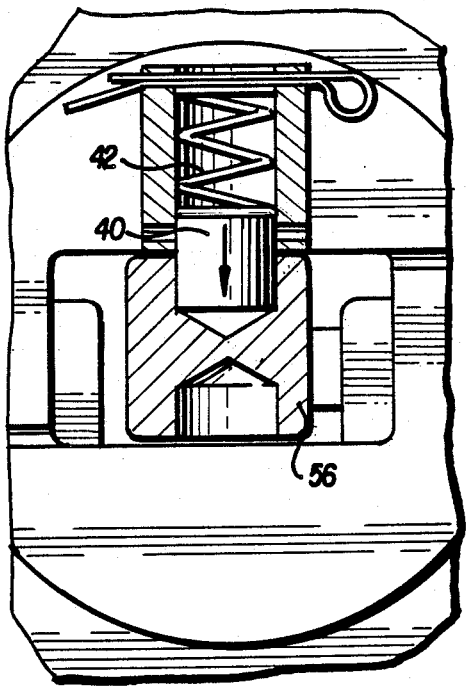
FIG. 7 is a fragmentary view partly in section taken along line 6—6 of FIG. 4 showing the locking pin jamming the operating lever after exposure to excessive heat.

FIG. 6 shows the push latch jamming mechanism during typical door operation. The operating lever 56 has a cavity 44. When the operating lever is in the return position, a locking pin 40 opposes the cavity 44 while being held rigidly by an extension 55 of the base plate 28. The locking pin 40 is mechanically biased by a spring 42 to move into the cavity 44 in the operating lever 56. If the locking pin 40 moves into the cavity 44, the door is inoperative, as shown in FIG. 7. This is because the locking pin 40 has a length that is greater than the depth of the cavity 44 in the operating lever. Accordingly, when the locking pin 40 is bottomed in the cavity, it also is partially held in the base plate extension 55. Because the cavity 44 in the operating lever is displaced from the axis of rotation of the operating lever 56, when the locking pin 40 is in the cavity 44, the operating lever cannot rotate. This jams the push door opener.

In normal operation, the locking pin 40 is retained out of the cavity 44 by a fusible link pin 60. Like the locking pin, the fusible link pin 60 is held rigidly by the base plate extension 55. Optimally the bulk of the push door mechanism 10 is made of an efficient heat conducting material and the link pin 60 is made of a low melting point material, the melting point being selected to be well above normal room temperature and at the lower range of temperatures found on a door during a fire, say about 600° to 650° F. When the push door opener 10 is subjected to heat, the link pin 60 melts and the locking pin 40 is thrust into the cavity 44 in the operating lever 56 by the bias spring 42. Under typical operation the bias spring 42 is compressed between an immovable part and the locking pin 40. Thus when the link pin 60 melts, all the bias spring's released energy is used to move the locking pin 40. In FIGS. 6 and 7 the immovable part is a cotter pin 34, though any element which would not move may be used here.

I claim:

1. A push-actuated door opener, for use on a door, comprising:

a base plate for attachment to a door;

an elongated axially moveable bolt which, when pulled into the door, allows it to open;

a push lever having a projection and a handle and means pivotally connecting the push lever to the base plate;

an operating lever having a cavity of a predetermined depth and means pivotally connecting the operating lever to the base plate, the operating lever further having a return position and being connected to the projection of the push lever on the base plate such that the operating lever rotates out of the return position to pull the bolt into the door when the push handle is pressed;

means for urging the operating lever to the return position;

a locking pin which is longer than the depth of said cavity in the operating lever, the locking pin being held in the base plate opposite the cavity and means biasing the locking pin toward the cavity; and a fusible link pin, connected to the base plate and positioned to retain the locking pin in the base plate out of the cavity when said fusible link pin has not been exposed to a high temperature but permitting said locking pin biasing means to move said locking pin when exposed to a high temperature.

2. A push-operated door opener as in claim 1, in which at least the base thereof is made of a highly efficient heat conductor.

3. A push-operated door opener as in claim 1, where the operating lever further comprises:

a first and a second arm which are substantially mutually orthogonal, the first arm contacting the projection of the push lever such that the actuation of the push handle causes the push lever to rotate about a first pivot pin, causing the projection to move the first arm, whereby the operating lever rotates about a second pivot pin and further the second arm of the operating lever pulls the bolt into the door.

4. A push-operated door opener as in claim 3, wherein the first pivot pin is perpendicular to the second pivot pin.

5. A push-operated door opener as in claim 4, wherein the first pivot pin is horizontal and the second pivot pin is vertical.

6. A push-operated door opener as in claim 1, wherein the means for urging the operating lever is a torsional spring which contacts both the operating lever and the base plate.

7. A push-operated door opener as in claim 1, wherein the means for biasing the locking pin is a compressed spring.

8. A push-operated door opener as in claim 1, wherein the locking pin is above the operating lever.

9. A push-actuated door opener, for use on a door, comprising:

a base plate for attachment to a door;

an elongated, axially moveable bolt which, when pulled into the door, allows it to open;

a push lever having a projection and a handle, the push lever being connected to the base plate on a first pivot pin;

an operating lever having a cavity of a predetermined depth, the operating lever being held on the base plate on a second pivot pin which is perpendicular to the first pivot pin, the operating lever further having a return position and being connected to the projection of the push lever on the base plate such that the operating lever rotates out of the return position to pull the bolt into the door when the push handle is pressed;

a torsional return spring which contacts both the operating lever and the base plate, and which urges the operating lever to the return position;

a locking pin which is longer than the depth of the cavity in the operating lever, the locking pin being held in the base plate opposite cavity in the operating lever, but not below the cavity and further the locking pin urged toward the cavity by a bias spring; and a fusible link pin, connected to the base plate and positioned to retain the locking pin in the base plate out of the cavity.

* * * * *